US005189241A

United States Patent [19]

Nakamura

[11] Patent Number: 5,189,241

[45] Date of Patent: Feb. 23, 1993

[54] PICKUP APPARATUS FOR DETECTING STRING VIBRATION FREE FROM EXTERNAL INDUCTIVE NOISE

[75] Inventor: Kazuhisa Nakamura, Tachikawa, Japan

[73] Assignee: Casio Computer Co., Ltd., Tokyo, Japan

[21] Appl. No.: 615,474

[22] Filed: Nov. 19, 1990

[30] Foreign Application Priority Data

Nov. 25, 1989 [JP] Japan ..... 1-136347[U]
Dec. 4, 1989 [JP] Japan ..... 1-314551

[51] Int. Cl.[5] ..... G10H 1/02; G10H 3/18
[52] U.S. Cl. ..... 84/728; 84/737
[58] Field of Search ..... 84/701-711, 84/723-743

[56] References Cited

U.S. PATENT DOCUMENTS 4,372,187 2/1983 Berg ..... 84/725 X
4,581,975 4/1986 Fender ..... 84/728
4,676,134 6/1987 Newell ..... 84/711 X
4,730,530 3/1988 Bonanno ..... 84/724
4,928,563 5/1990 Murata et al. .
4,941,388 7/1990 Hoover et al. ..... 84/726

FOREIGN PATENT DOCUMENTS 52-118623 9/1977 Japan .
57-43498 3/1982 Japan .
57-44393 9/1982 Japan .
63-18066 5/1988 Japan .

*Primary Examiner*—Stanley J. Witkowski
*Attorney, Agent, or Firm*—Frishauf, Holtz, Goodman & Woodward

[57] ABSTRACT

A pickup apparatus for use in an electronic stringed instrument. This apparatus has a differential amplifier which eliminates noise included in a pickup signal output from an electromagnetic pickup and outputs the resultant pickup signal. This pickup signal is added with a predetermined effect by an effect adding section. The tone parameter of the effect-added pickup signal is changed by an external manipulation.

15 Claims, 14 Drawing Sheets

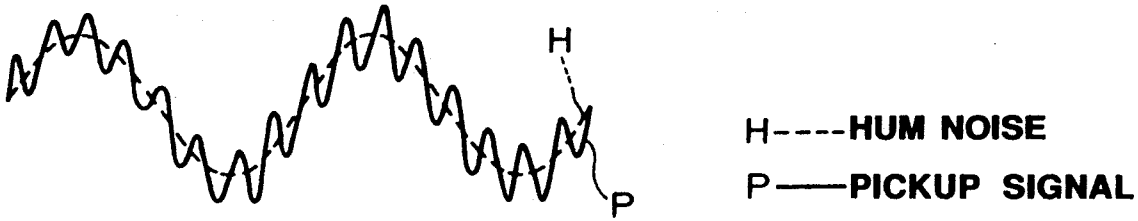
FIG. 3A POINT A
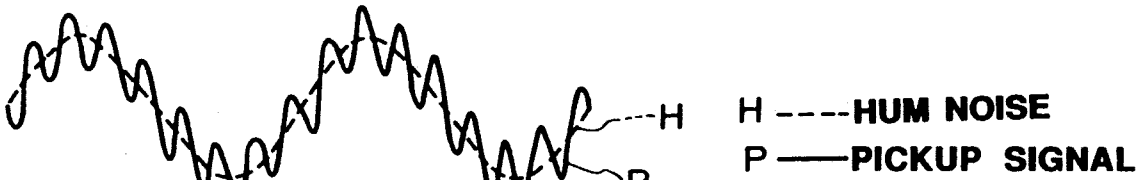
FIG. 3B POINT B
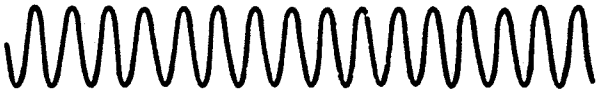
FIG. 3C POINT C

FIG.12

| C1 | C2 | SWC1 | SWC2 | SWC3 | SWC4 |
|---|---|---|---|---|---|
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

1 : HIGH LEVEL
0 : LOW LEVEL

FIG.14

| C1 | C2 | FIRST SWITCH | SECOND SWITCH | THIRD SWITCH | FOURTH SWITCH |
|---|---|---|---|---|---|
| 0 | 0 | OPEN | OPEN | CLOSED | CLOSED |
| 0 | 1 | OPEN | CLOSED | CLOSED | OPEN |
| 1 | 0 | CLOSED | OPEN | OPEN | CLOSED |
| 1 | 1 | CLOSED | CLOSED | OPEN | OPEN |

0 : LOW LEVEL
1 : HIGH LEVEL

PICKUP APPARATUS FOR DETECTING STRING VIBRATION FREE FROM EXTERNAL INDUCTIVE NOISE

BACKGROUND OF THE INVENTION

1. Field of the Invention

The present invention relates to a pickup apparatus which converts the vibration of a string of a stringed instrument into an output electric signal.

2. Description of the Related Art

A conventional pickup apparatus as disclosed in Published Unexamined Japanese Utility Model Application No. 52-118623 has been proposed. This pickup apparatus comprises a casing and a plurality of pickup sections. Pickup signals from the individual pickup sections are supplied to respective preamplifiers provided outside the pickup apparatus for amplification. The amplified pickup signals are sent to a mixing device and an effect circuit. If the effect circuit is a distortion circuit, for example, it produces a signal with a distortion characteristic to the pickup signals. The distorted signal is added to the original pickup signal from the associated pickup section (pickup signal without any effect added thereto), and the resultant signal is sent to an amplifier for amplification. Loudspeakers are driven on the basis of the amplified signal from this amplifier to generate a musical sound having an effect added by the effect circuit.

Since the conventional pickup apparatus simply has pickups arranged in the casing, it is necessary to provide an effect circuit inside or outside the body of a musical instrument and electrically connect it to the pickups. As a result, lead lines which electrically connect the pickups to the effect circuit run around inside or outside the instrument body, complicating the wiring. In addition, the long lead lines may easily pickup external noise, reducing the tone quality.

As a solution to this shortcoming, there has been proposed a pickup apparatus having a pickup and an effect circuit incorporated in the casing of this pickup, as disclosed in Published Unexamined Japanese Utility Model Application No. 57-43498. This pickup apparatus can overcome at least the problem of external noise originating from the presence of the long lead lines to connecting the pickup to the effect circuit. If the pickup is of an electromagnetic type in the pickup apparatus, the presence of coils causes a pickup signal having noise, such as inductive hum, to be output from the pickup. Consequently, the effect circuit inevitably adds an effect to the pickup signal carrying such noise, thus deteriorating the quality of a musical tone generated on the basis of the effect-added pickup signal.

Prior art pickup apparatus includes a single-coil-sound system and a hum-backing system. The former type pickup apparatus comprises a single pickup having a coil wound around a magnet, and presents a characteristic of good extension of treble and clear timbre. The latter type pickup apparatus comprises two pickups which have series-connected coils wound on a pair of magnets, respectively. Thus, permits noise to be eliminated by the phase difference between the outputs of the coils and provides a characteristic that facilitates picking up of bass components and presents a soft tone quality.

Since the single-coil-sound type pickup apparatus and the hum-backing type pickup apparatus have different characteristics, there has been proposed a pickup apparatus which ensure the proper selection between the single-coil-sound system and hum-backing system in order to make use of these characteristics in accordance with the music to be played (see Published Examined Japanese Utility Model Application No. 57-44393).

This pickup apparatus includes a pair of pickups each having a coil wound around its associated magnet, and a changeover switch connected between these coils, the switch being provided outside the pickup apparatus, e.g., on the body of a guitar.

When the switch is turned off in the above arrangement, both coils are connected in series, so that the pickup apparatus acts as the hum-backing system. When the switch is turned on, both ends of one of the pickups are grounded, and the other pickup alone functions, whereby the pickup apparatus acts as the single-coil-sound system. The ON/OFF operation of the changeover switch during a musical performance can provides both the characteristic of the single-coil-sound type pickup apparatus and that of the hum-backing type.

According to this conventional pickup apparatus, since the changeover switch for selecting between the single-coil-sound system and the hum-backing system is provided outside the pickup apparatus, lead lines which connect the switch to the coils run around in the instrument body and thus can easily pick up external noise. deteriorating the tone quality. Further, a preamplifier for amplifying the output signals from the coils should be provided separately, so that lead lines for connecting the pickups to the preamplifier should inevitably extend around in the instrument body, further increasing noise.

As a solution to this problem, there has been proposed a pickup apparatus as disclosed in Published Examined Japanese Utility Model Application No. 63-18066, which has a pickup provided integrally with a preamplifier that processes the output signal of the pickup, thus preventing lead lines from unnecessarily running around to connect the pickup and preamplifier, thus reducing noise.

If this apparatus is so designed as to ensure switching between single-coil-sound system and the hum-backing system in accordance with a music to be played, as described above, the changeover switch needs to be provided outside the pickup apparatus. Although this apparatus can prevent the occurrence of the noise originating from the lead lines connecting the pickups and the preamplifier, it cannot prevent the generation of noise originating from the lead lines connected to the changeover switch.

SUMMARY OF THE INVENTION

It is therefore an object of the present invention to provide a pickup apparatus which can eliminate noise on a pickup signal to prevent the quality of a musical tone from deteriorating due to external noise.

It is another object of the present invention to provide a pickup apparatus which can add an effect or the like to a pickup signal.

It is a still another object of the present invention to provide a pickup apparatus which can prevent adverse influence of the external noise.

It is a further object of the present invention to provide a pickup apparatus capable of outputting a pickup signal to which multifarious effects are added by an external manipulation.

It is a still further object of the present invention to provide a pickup apparatus capable of eliminating not only noise originating lead lines connecting a pickup and a preamplifier, but also noise originating from lead lines connecting the pickup and a changeover switch.

According to one aspect of the present invention, there is provided a pickup apparatus comprising electromagnetic pickup means for converting vibration of a string into an electric pickup signal and outputting the electric signal; and differential amplifier means for receiving the pickup signal from the electromagnetic pickup means at two input sections and amplifying the pickup signal received at the two input sections.

With this arrangement, a noise component on the pickup signal from the electromagnetic pickup means is removed by the differential amplifier means and the noise-free pickup signal is output therefrom. Even the use of a low-cost electromagnetic pickup can provide a pickup signal free of noise.

According to another aspect of the present invention, a pickup apparatus comprises, besides the differential amplifier means (hereinafter termed an effected means), an added-effect means (hereinafter called an effecter means) for adding a predetermined effect to the pickup signal from the differential amplifier means.

The provision of the added-effect means can add an effect to a noise-free pickup signal.

According to a still another aspect of the present invention, there is provided a pickup apparatus comprising pickup means for detecting, vibration of a string and outputting a pickup signal; added-effect means for adding a predetermined effect to the pickup signal from the pickup means; and parameter change i.e., characteristic control means for altering a tone parameter of the pickup signal added with the predetermined effect by the added effect means, by an external manipulation.

With this arrangement, manipulating the parameter change means can change the tone parameter of that pickup signal which is added with a predetermined effect by the effecter means, thus permitting the degree of the effect to be altered in accordance with a music that is played.

According to a further aspect of the present invention, there is provided a pickup apparatus comprising a plurality of pickup means for detecting vibration of strings and outputting pickup signals; a plurality of effecter means for respectively adding predetermined effects to the pickup signals from the plurality of pickup means; and a plurality of characteristic control means for altering tone parameters of the pickup signals respectively added with the predetermined effects by the plurality of effecter means, by an external manipulation.

Providing a plurality of effecter means and a plurality of characteristic control means in association with a plurality of pickup means as in the above arrangement ensure alteration of tone parameters for each of the plurality of pickup means corresponding to a plurality of strings, for example, so that the parameter change of the effecter means can be freely done for each string.

According to a still further aspect of the present invention, mixing means is further provided to mix pickup signals from the plurality of effecter means and output the resultant signal.

The provision of such mixing means can allow the signals from the individual effecter means to be output from a single output section.

According to a different aspect of the present invention, there is provided a pickup apparatus comprising pickup means for detecting vibration of a string and outputting a pickup signal; effecter means for adding a predetermined effect to the pickup signal from the pickup means; mixing means for mixing the pickup signal added with the predetermined effect by the effecter means with the pickup signal directly output from the pickup means and outputting a resultant signal as a mixed pickup signal; and select means for selecting one of the mixed pickup signal from the mixing means and the pickup signal directly output from the pickup means.

As the pickup signal added with an effect by the effecter means is mixed with the pickup signal directly output from the pickup means by the mixing means and the resultant mixed pickup signal or the original pickup signal directly output from the pickup means is selectively output to the outside, it is possible to select whether to generate the original tone mixed with the effect-added tone, or only the original tone.

According to a still different aspect of the present invention, there is provided a pickup apparatus comprising pickup means for detecting vibration of a string and outputting a pickup signal; a plurality of effecter means for respectively adding different types of effects to the pickup signal from the pickup means; and select means for selecting an arbitrary one of the plurality of effecter means and outputting outside the pickup signal added with a specific effect by the selected effecter means.

In this case, the select means selects one or more of the plurality of effecter means.

As arbitrary one of a plurality of effecter means can be selected by the select means, it is possible to provide a variety of musical tones. Selectively activating not only one or more effecter means can provide a musical tone having a single effect added thereto as well as a musical tone added with a plurality of effects, making the variety of musical tones richer.

In the individual arrangements described above, it is preferable that the pickup means, the plurality of effecter means, and the select means are provided on a common pickup support member. It is further preferable that the pickup support is provided with an electromagnetic shield member for enclosing the electromagnetic pickup means.

If the individual means associated with the pickup means are provided on the common pickup support member, lead lines connecting these means are unnecessary, thus preventing the tone quality from being deteriorated due to external noise on such lead lines. Further, if the pickup means and the other individual means are all enclosed by the magnetic shield member, the external noise can be shielded more effective.

According to a still yet another aspect of the present invention, a plurality of pickup means, pickup switching means for selectively connecting the plurality of pickup means in predetermined different connecting modes, and signal amplifier means for amplifying a pickup signal from those specific pickup means which are connected by the pickup switching means are incorporated as one unit in a pickup support member.

According to this invention, when the pickup means are connected in one of a predetermined number of different connecting modes, e.g., single-coil-sound system or hum-backing system, by the switching means, a pickup signal having a characteristic corresponding to the selected connecting mode is output, and is amplified by the signal amplifier means before being output to the outside of the pickup apparatus. At this time, since the pickup means, the switching means and the signal amplifier means are incorporated as one unit in the pickup apparatus, external noise hardly appears among these means, so that a signal having a desired characteristic can be produced with high fidelity.

According to a still yet further aspect of the present invention, a plurality of pickup means having different pickup characteristics, a plurality of signal amplifier means for respectively amplifying pickup signals from the plurality of pickup means, and amplifiedsignal select means for selectively outputting the pickup signals amplified by the plurality of signal amplifier means are incorporated as one unit in a pickup support member.

According to this invention, a plurality of pickup means output pickup signals corresponding to their respective characteristics, these pickup signals are amplified by the associated amplifier means, and the amplified signals are properly selected by the amplified-signal select means and output from the pickup apparatus. Since the pickup means, the signal amplifier means and the amplified-signal select means are incorporated as one unit in the pickup apparatus, no external noise would appear among these individual means.

According to a still yet different aspect of the present invention, mixing means for mixing the pickup signals amplified by a plurality of signal amplifier means and outputting the resultant signal, and effecter means for changing a tone characteristic of the pickup signal amplified by the amplifier means are incorporated as one unit in a pickup apparatus. It is preferable that the mentioned individual means be enclosed by an electromagnetic shield member.

The provision of the mixing means can alter the characteristic of the pickup signal output from the pickup apparatus. Further, the provision of the effecter means can provide a pickup signal added with an effect to a musical tone to be generated. No external noise would appear among the mixing means, effecter means and other means. In addition, if these means incorporated in the pickup apparatus are enclosed by a shield member, the external noise can be shielded more effectively.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 3A, 3B, and 3C are diagrams illustrating waveforms at points A, B, and C shown in FIG. 2 according to this embodiment;

FIG. 12 is a diagram illustrating the operation of a decoder according to this embodiment;

FIG. 14 is a diagram illustrating the operation of this embodiment;

DETAILED DESCRIPTION OF THE PREFERRED EMBODIMENTS

One preferred embodiment of the present invention will now be described referring to the accompanying drawings.

Figure 1:
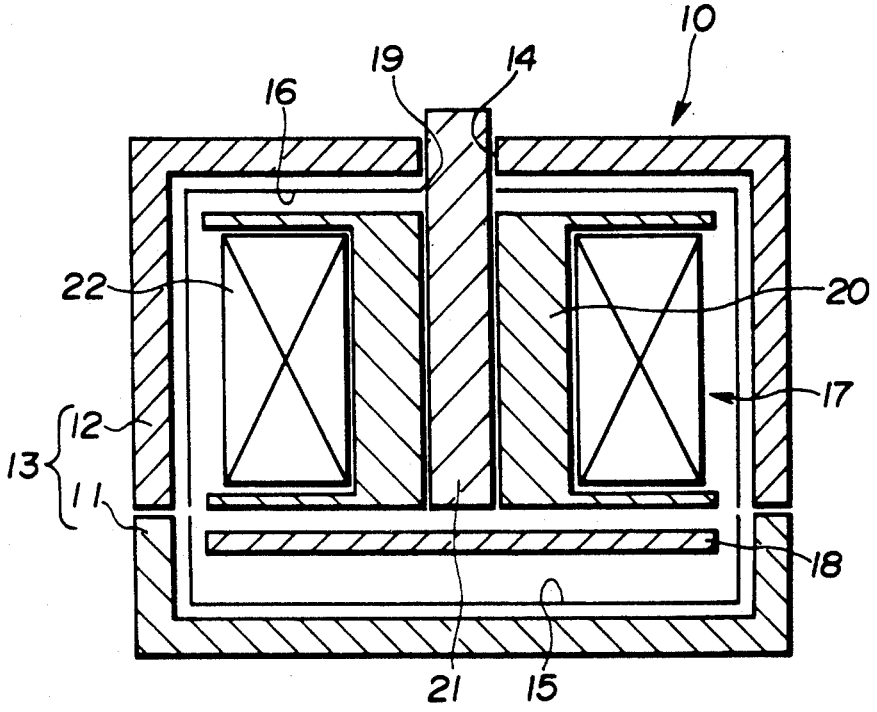
FIG. 1 is a conceptual cross section illustrating the first embodiment of the present invention.

FIG. 1 illustrates the first embodiment of the present invention. A pickup device 10 comprises a casing 13 serving as a pickup support including a lower case 11 and an upper case 12. In approximately the middle of the upper wall of the upper case 12 an opening 14 is provided. A lower shield 15 and an upper shield 16 formed of a magnetic shield material are arranged along the inner walls of the lower and upper cases 11 and 12 inside the casing 13. In the upper shield 16 is a hole 19 formed facing the opening 14.

An electromagnetic type pickup 17 and a printed circuit board 18 located under the pickup 17 are placed in the inner space surrounded by the upper and lower shields 15 and 16. The pickup 17 includes a bobbin 20, a magnet arranged in the center of the bobbin 20, and a coil 22 wounded on the bobbin 20. The upper end of the magnet 21 protrudes over the casing 13 through the hole 19 and the opening 14.

Figure 2:
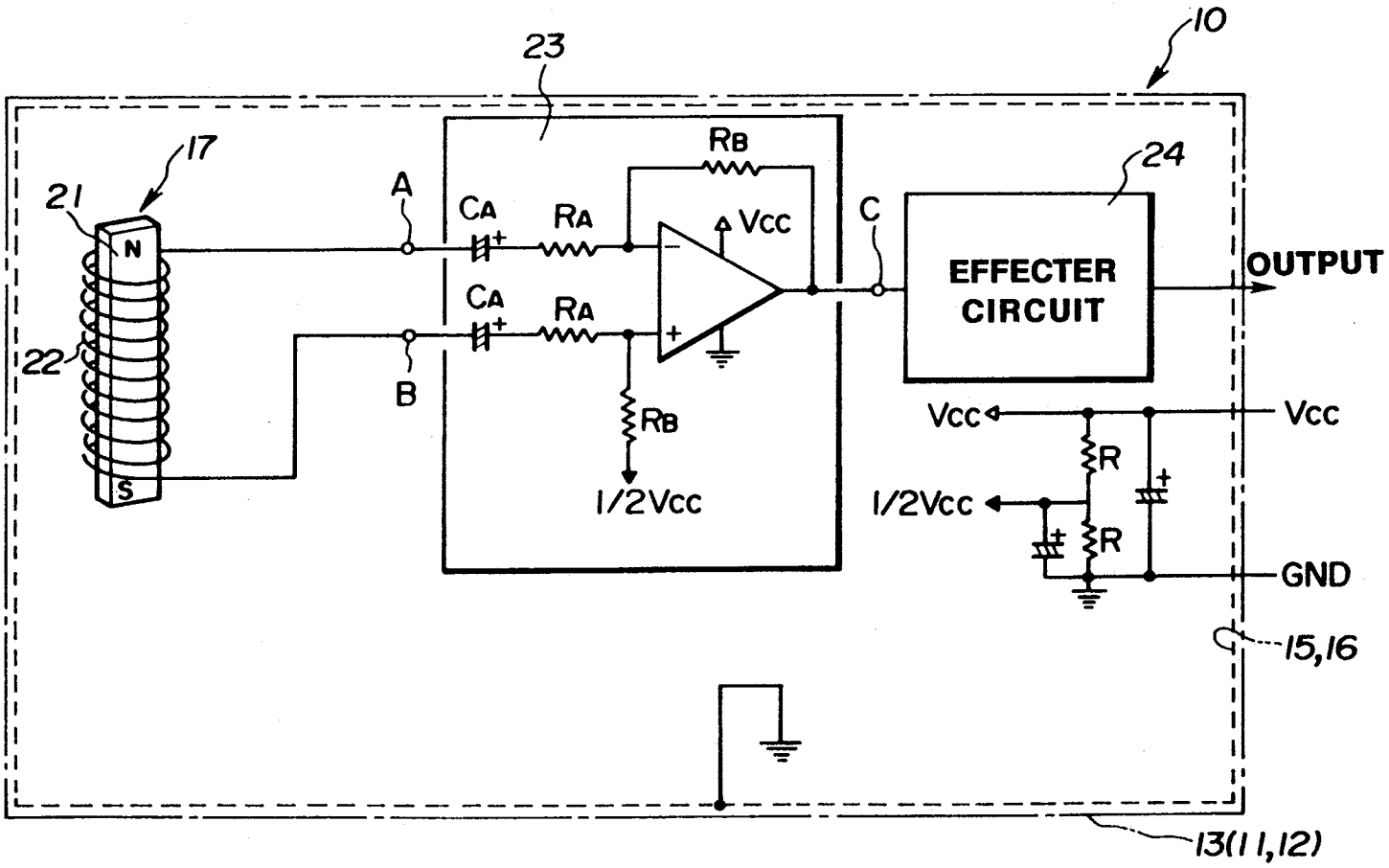
FIG. 2 is a circuit diagram of this embodiment.

A differential amplifier 23 and an effecter circuit 24 are provided on the printed circuit board 18 as shown in FIG. 2. The differential amplifier 23 has its inverting terminal (−) and non-inverting terminal (+) connected to the ends of the coil 22 each via a coupling capacitor $C_A$ and a resistor $R_A$. The differential amplifier 23 eliminates in-phase noise such as inductive hum noise from a pickup signal and send this signal to the effecter circuit 24. The effecter circuit 24 has an operational characteristic which varies depending on its type; for example, a so-called chorus type effecter circuit generates a delayed tone signal with respect to the original signal from the amplifier 23 and adds these signals together, and outputs this signal to a sound system (not shown), which is located outside the pickup device 10 and comprises an amplifier and loudspeakers.

Both shields 15 and 16 are connected to the ground terminal of the printed circuit board 18. The power supply voltage $V_{CC}$ is supplied from outside the pickup device 10.

In the thus structured embodiment, when a string of a stringed instrument vibrates, the pickup 17 converts this vibration into an electronic signal and outputs it.

Because the pickup 17 is of an electromagnetic type, as shown in FIGS. 3A and 3B, a pickup signal P consisting of the electronic signal carries in-phase hum noise H at points A and B indicated in FIG. 2. Assuming that the pickup signal in such a state is amplified, the in-phase hum noise H would be amplified together with the pickup signal. Upon reception of the amplified signal, therefore, the sound system would reproduce both the pickup signal and the in-phase hum noise H, deteriorating the tone quality. According to the embodiment, however, since the pickup signal with hum noise H from the electromagnetic pickup 17 is sent to the amplifier 23, the in-phase hum noise H can be eliminated according to the in-phase signal eliminating ratio of the amplifier 23.

The pickup signal P with the in-phase hum noise H eliminated can be obtained at a point C, the output stage of the amplifier 23, as shown in FIG. 3C. Therefore, even using an inexpensive electromagnetic pickup 17, it is possible to gain a noiseless pickup signal, and to add an effect to the noiseless pickup signal P by the effecter circuit 24 so as to release an effect-added sound of high quality.

Further, since the pickup 17 and the effecter circuit 24 are incorporated as one unit in the casing 13 of the pickup device 10, lead lines which connect the pickup 17 to the effecter circuit 24 would not run around inside the instrument body, thus preventing the lead line from picking up external noise as much as possible.

Since the amplifier 23 is also incorporated together with the pickup 17 and the effecter circuit 24 as one unit in the casing 13 of the pickup device 10, lead lines, which connect the pickup 17 to the effecter circuit 24 and the amplifier 23 to the effecter circuit 24, need not run around inside and outside the instrument body. This can inhibit the lead line from having the external noise, thereby preventing deterioration of the tone quality, otherwise caused by the noise on the each lead line.

Because the pickup 17, the differential amplifier 23, and effecter circuit 24 are entirely surrounded by the upper and lower shields 15 and 16, the connecting lines hardly have external noise. Therefore, the effecter circuit 24 can add an effect to the pickup signal, and thus provides musical tones of high quality.

Figure 4:
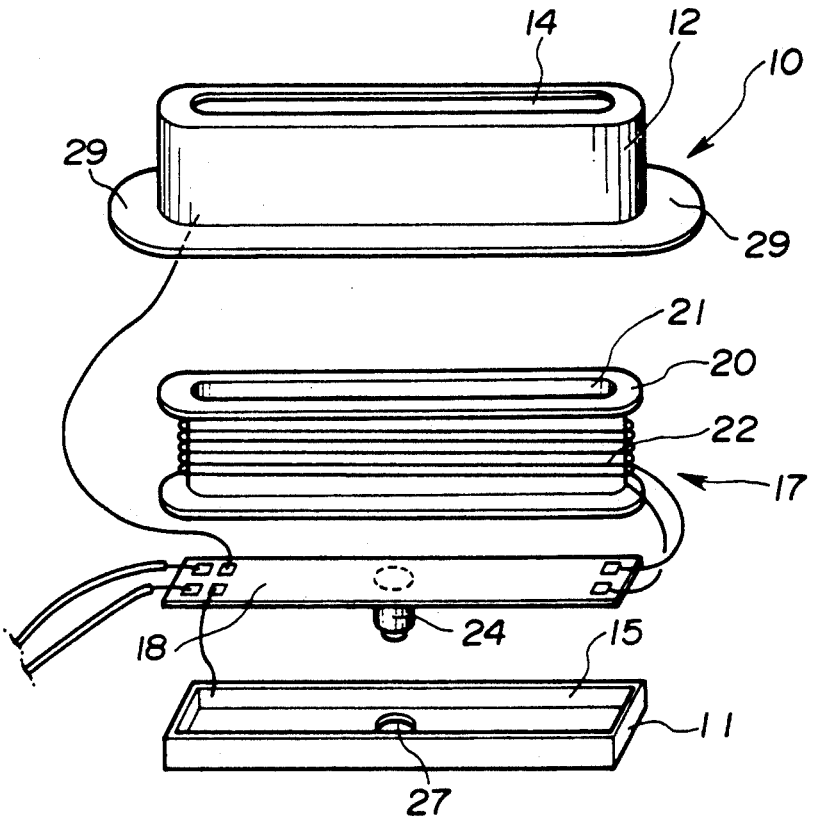
FIG. 4 is an exploded perspective view illustrating the second embodiment of the present invention.
Figure 5:
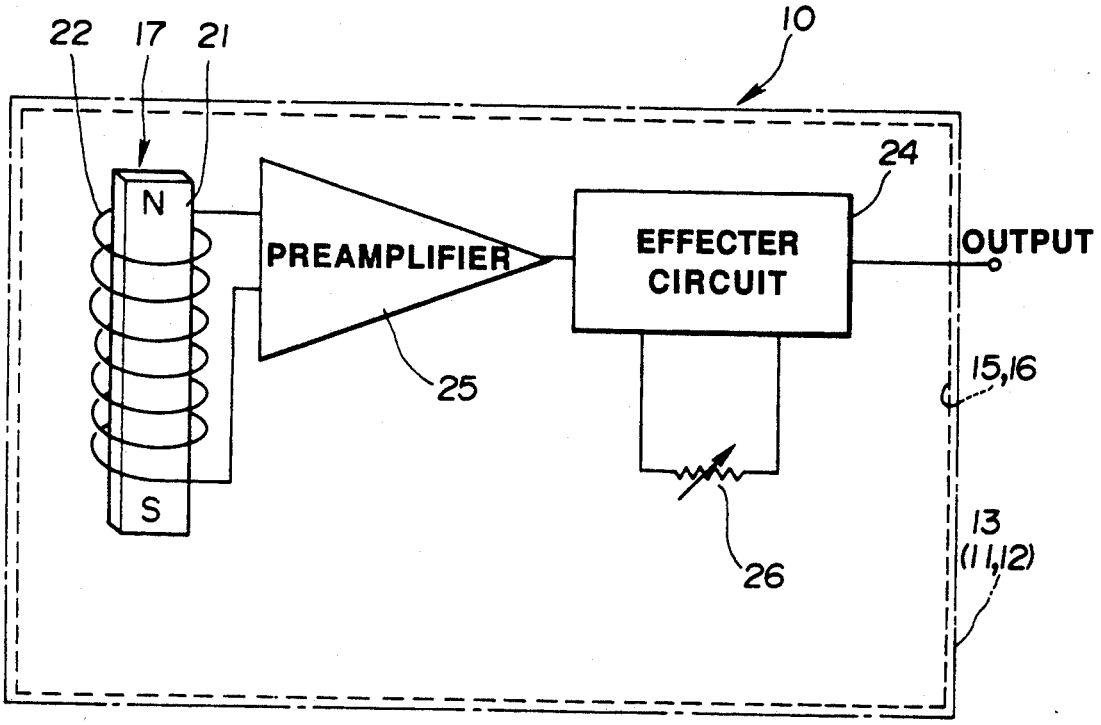
FIG. 5 is a circuit diagram of this embodiment.
Figure 6:
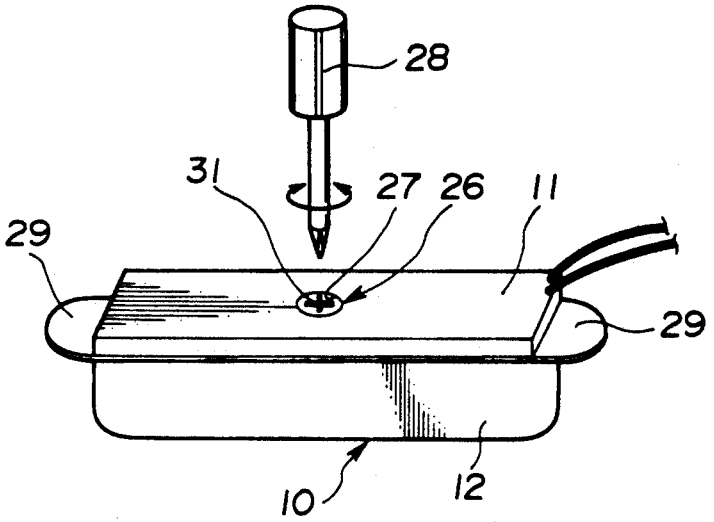
FIG. 6 is a perspective view illustrating the operation of changing parameters according to the second embodiment.

FIGS. 4 to 6 illustrate the second embodiment of the present invention. Walls inside the lower case 11 and the upper case 12 are painted for conductivity. These walls are connected to the ground terminal of the printed circuit board 18, forming the lower shield 15 and the upper shield 16. Arranged on the printed circuit board 18 are a preamplifier 25 which is connected to both ends of the coil 22, the effecter circuit 24 receiving the output of the preamplifier 25, and a rotatable volume 26 as shown in FIG. 5.

The volume 26 serves to change parameters of the effecter circuit 24 in accordance with the rotational position of the volume 26. For example, in a case of the effecter circuit 24 presenting distortion, the volume 26 changes the distortion level; in a case involving delay, it changes the delay time. As shown in FIG. 4, one end of the volume 26 is supported rotatable by the printed circuit board 18, while the other end is exposed to the outside of the casing 13 through an attaching hole 27 formed in the lower case 11, and has a cutaway 31 as shown in FIG. 6.

The upper case 12 in the embodiment has side flanges 29 formed integrally. The side flanges 29 are held on the body of the musical instrument (not shown), so that the pickup device 10 is secured detachable to the musical instrument.

According to the second embodiment, after the pickup device 10 is detached from the musical instrument, the parameter of the effecter circuit 24 can be changed by tightening or loosening the volume 26 with a screw driver 28. The characteristic of the effecter circuit 24 is changed easily and quickly, and since the volume 26 is supported by the printed circuit board 18 where the effecter circuit 24 is provided, it is not necessary to use the lead lines to connect the effecter circuit 24 to the volume 26. It is therefore possible to avoid the problem of the external noise appearing on the lead lines, to change the parameters of the effecter circuit 24, and to allow the pickup device 10 to be less influenced by the external noise.

Figure 7:
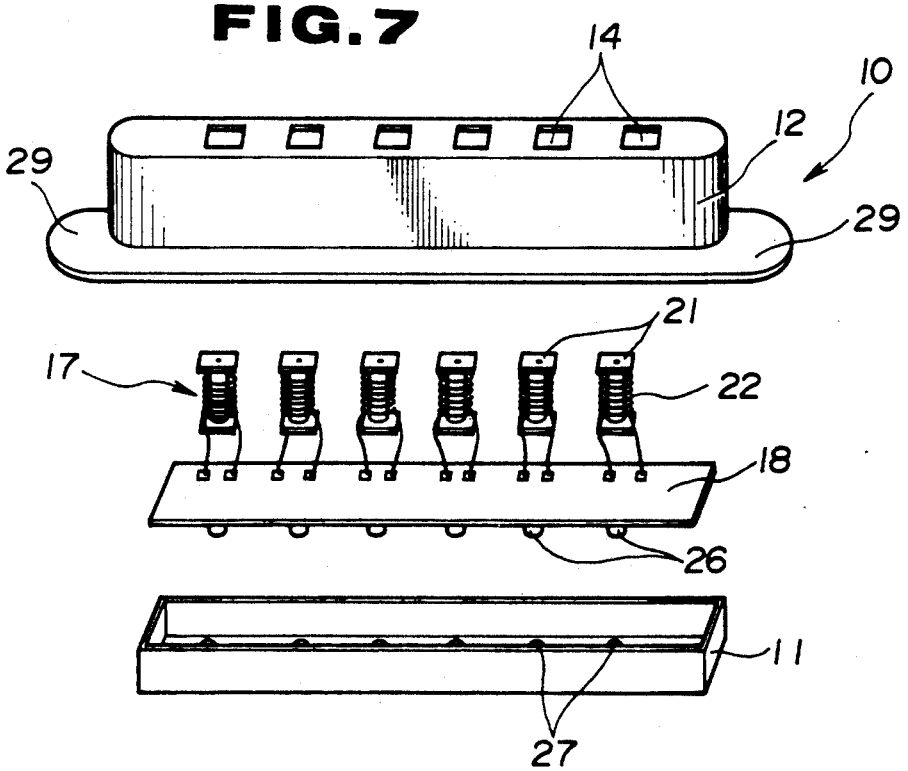
FIG. 7 is an exploded perspective view illustrating the third embodiment of the present invention.
Figure 8:
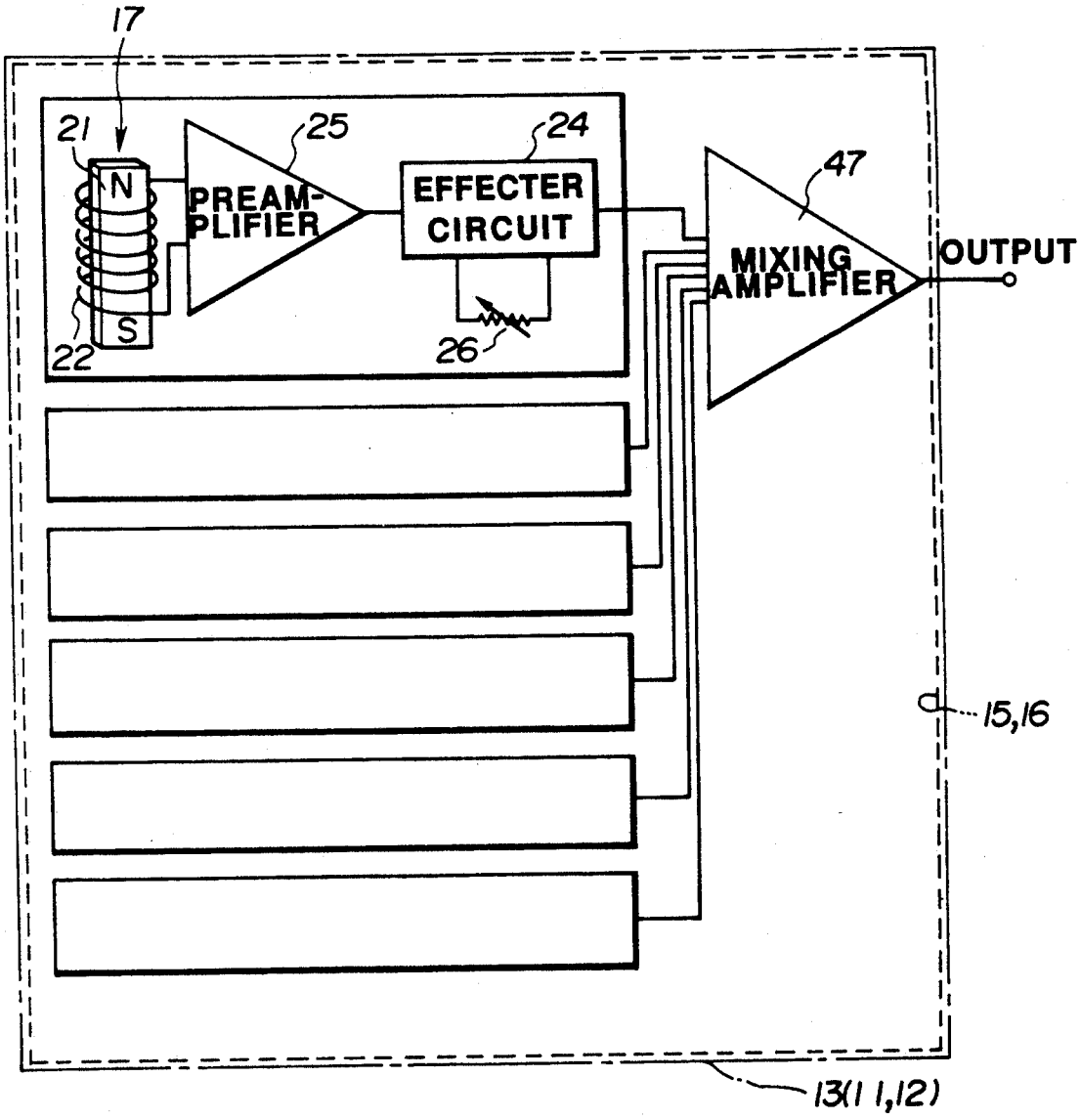
FIG. 8 is a circuit diagram of this embodiment.
Figure 9:
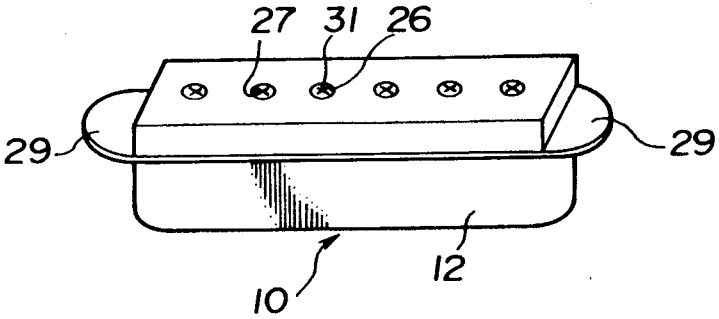
FIG. 9 is a perspective view illustrating the third embodiment from the back.

FIGS. 7 to 9 illustrates the third embodiment of the present invention. Six pickups 17 are provided in the pickup device 10 for the respective strings of a six-stringed guitar. For each pickup 17, the preamplifier 25, the effecter circuit 24, and the volume 26 are provided. A signal from each effecter circuit 24 is supplied to a mixing amplifier 47 from which its amplified signal is output.

According to the third embodiment, after the pickup device 10 is removed from the musical instrument, as shown in FIG. 9, the parameter can be changed for each effecter circuit 24 by rotating the volumes 26 with the screw driver 28 (see in FIG. 6). Therefore, the parameter alteration is available for each of the pickups 17 corresponding to the respective strings, and an effect can be added to the characteristics which are different among tones of strings. Since the outputs from all the effecter circuits 24 are mixed by the mixing amplifier 47 and sent out, even if a plurality of effecter circuits 24 are arranged, only one lead line is led outside the pickup device 10, suppressing the influence of the external noise as much as possible.

Figure 10:
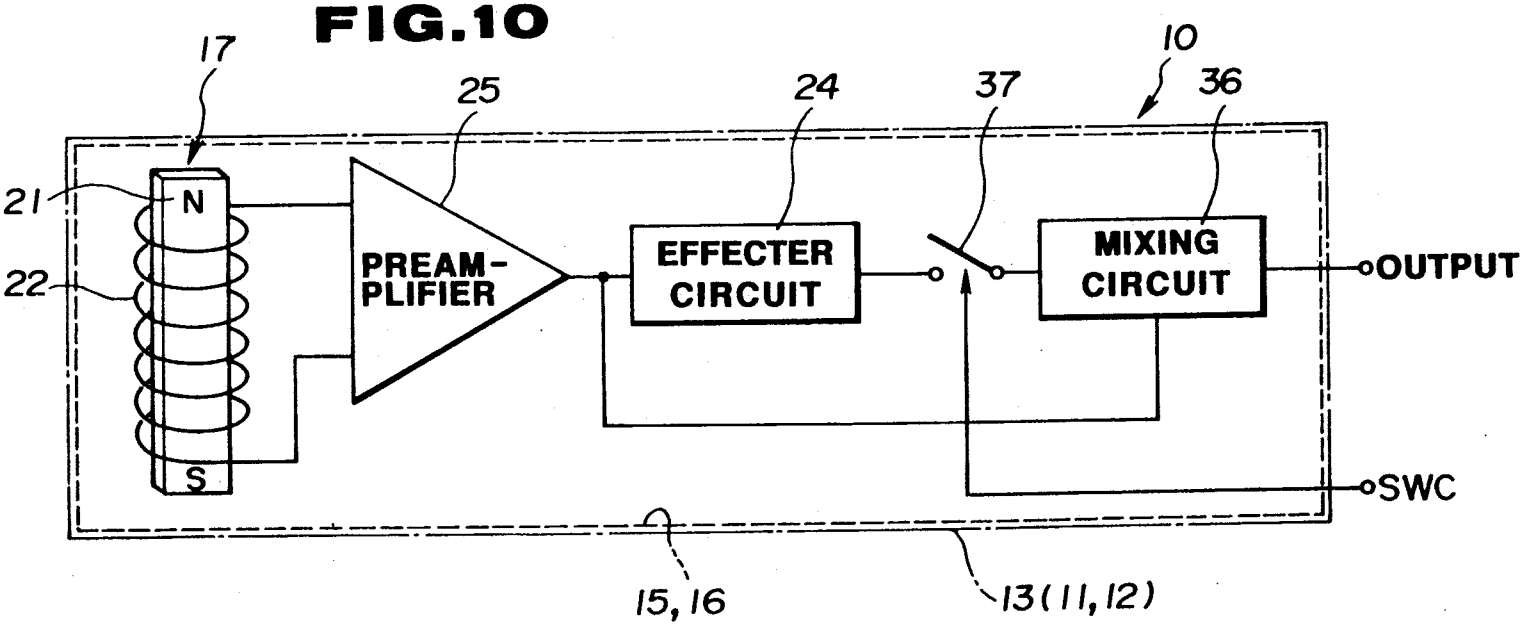
FIG. 10 is a circuit diagram illustrating the fourth embodiment of the present invention.

FIG. 10 illustrates the fourth embodiment of the present invention. The effecter circuit 24 adds an effect to a direct signal from the preamplifier 25, and adds the effect-added signal to the direct signal in a mixing circuit 36, as described above for a chorus. Between the mixing circuit 36 and the effecter circuit 24 there is an electronic switch 37 to be open and closed by a control signal SWC supplied from a CPU (not shown).

According to the forth embodiment, when the electronic switch 37 is closed, the effecter circuit 24 sends the effect-added signal, which is then added to the direct signal in the mixing circuit 36 before being output. When the switch 37 is open, only the direct signal is sent to the mixing circuit 36 and is sent out as it is. In this embodiment, depending on the presence or absence of the control signal SWC, it is possible to select the releasing of the original tone mixed with the effect-added one, or releasing of the original tone only. Therefore, a variety of performances is possible by properly releasing a musical tone having the original tone mixed with the effect-added tone, or a musical tone with the original tone only during the performance.

Figure 11:
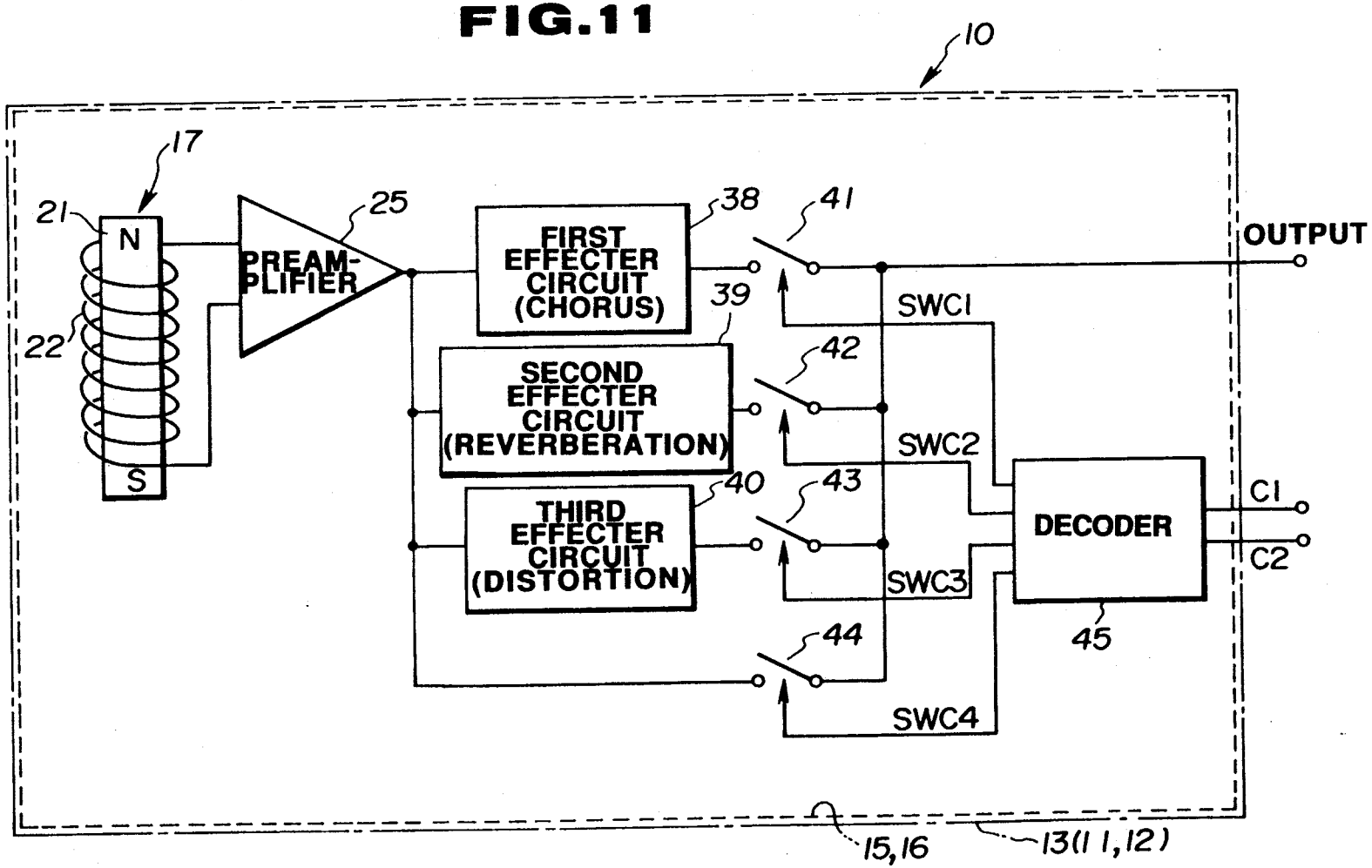
FIG. 11 is a circuit diagram illustrating the fifth embodiment of the present invention.

FIG. 11 illustrates the fifth embodiment of the present invention. A first effecter circuit 38, a second effecter circuit 39, and a third effecter circuit 40, all incorporated in the casing 13, are connected in parallel to the output terminal of the preamplifier 25. These effecter circuits 38, 39, and 40 differ in type; for example, the first effecter circuit 38 is of a chorus type, the second effecter circuit 39 of a reverberation type, and the third effecter circuit 40 of a distortion type.

First to third switches 41, 42, and 43 are located between the first, second, and third effecter circuits 38, 39, and 40 and the output terminal of the pickup device 10, while a fourth switch 44 is arranged between the preamplifier 25 and the output terminal of the pickup device 10. These first to fourth switches 41 to 44 are electronic switches, which are closed when the levels of the control signals SWC1, SWC2, SWC3, and SWC4 from a decoder 45 become high. The decoder 45 sets any one of the control signals SWC1, SWC2, SWC3, and SWC4 high in accordance with the statuses of control signals C1 and C2 supplied from an external CPU.

When the control signals C1 and C2 are at a low level, for example, the control signal SWC1 becomes high and only the first switch 41 is closed, thereby permitting the first effecter circuit 38 to add a chorus effect. Likewise, the control signals SWC2 and SWC3 become high in accordance with the statuses of the control signals C1 and C2, and the second and third switches 42 and 43 are closed, adding reverberation and distortion effects to the pickup signal. When the control signal SWC 4 becomes high and the fourth switch 44 is closed, a direct signal without any effect added thereto is output. In response to the control signals C1 and C2, any one of the plurality of the effect-added tones, or the original tone can be generated, so that a variety of effect addition can be executed using a single pickup device 10.

Figure 13:
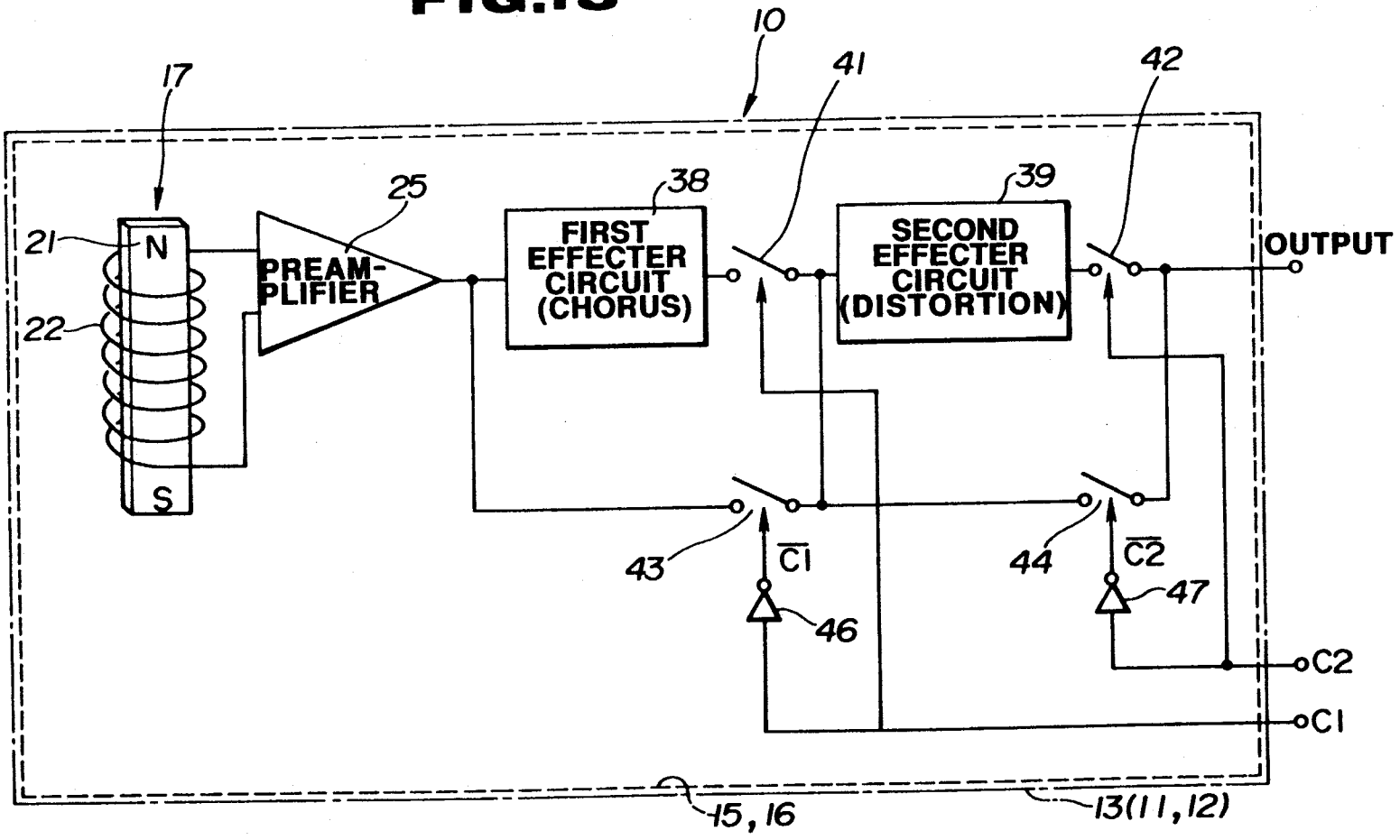
FIG. 13 is a circuit diagram illustrating the sixth embodiment of the present invention.

FIG. 13 shows the sixth embodiment of the present invention. The first effecter circuit 38 (chorus type) is connected in series to the second effecter circuit 39 (distortion type) via the first switch 41. The second switch 42 is provided between the second effecter circuit 39 and the output terminal of the pickup device 10. The third switch 43 is located between the output terminal of the preamplifier 25 and the input terminal of the second effecter circuit 39. Between the third switch 43 and the output terminal of the pickup device 10 is the fourth switch 44 arranged. The first switch 41 and the second switch 42 are open and closed by the control signals C1 and C2 sent directly from a CPU (not shown). The third switch 43 and the fourth switch 44 are open and closed by the control signals C1 and C2 sent via inverters 46 and 47 from the CPU.

The output levels of the control signals C1 and C2 and the open/close statuses of the respective switches 41 to 44 are illustrated in FIG. 14. If the levels of the control signals C1 and C2 become low, the third and fourth switches 43 and 44 are closed, so that the signal from the preamplifier 25 is output directly from the pickup device 10, without going through the first and second effecter circuits 38 and 39.

When the level of the control signal C1 is low and that of the control signal C2 is high, the second and third switches 42 and 43 are closed. The signal from the preamplifier 25 is sent to the second effecter circuit 39 where it is added with an effect, and the resultant signal is output directly from the pickup device 10 via the second switch 42. When the control signal C1 is at a high level and the control signal C2 is at low level, the first and fourth switches 41 and 44 are closed, sending both signals to the first effecter circuit 38. When the control signals C1 and C2 are both at a high level, the first and second switches 41 and 42 are closed. As a result, these signals are sent to the first effecter circuit 38, whose output is in turn supplied to the second effecter circuit 39.

Accordingly the effecter circuit 38 or 39 can be selected in accordance with the levels of the control signals C1 and C2, and when the first effecter circuit 38 sends its output to the second effecter circuit 39, it is possible to acquire a tone characteristic with a plurality of effects added to a musical tone, i.e., the chorus and distortion. Therefore, not only a single-effect added musical tone but a musical tone added with a plurality of effects can be obtained. A special effect, which cannot be acquired by the existing effecter, can be added by giving a plurality of the effects to a musical tone.

Figure 15:
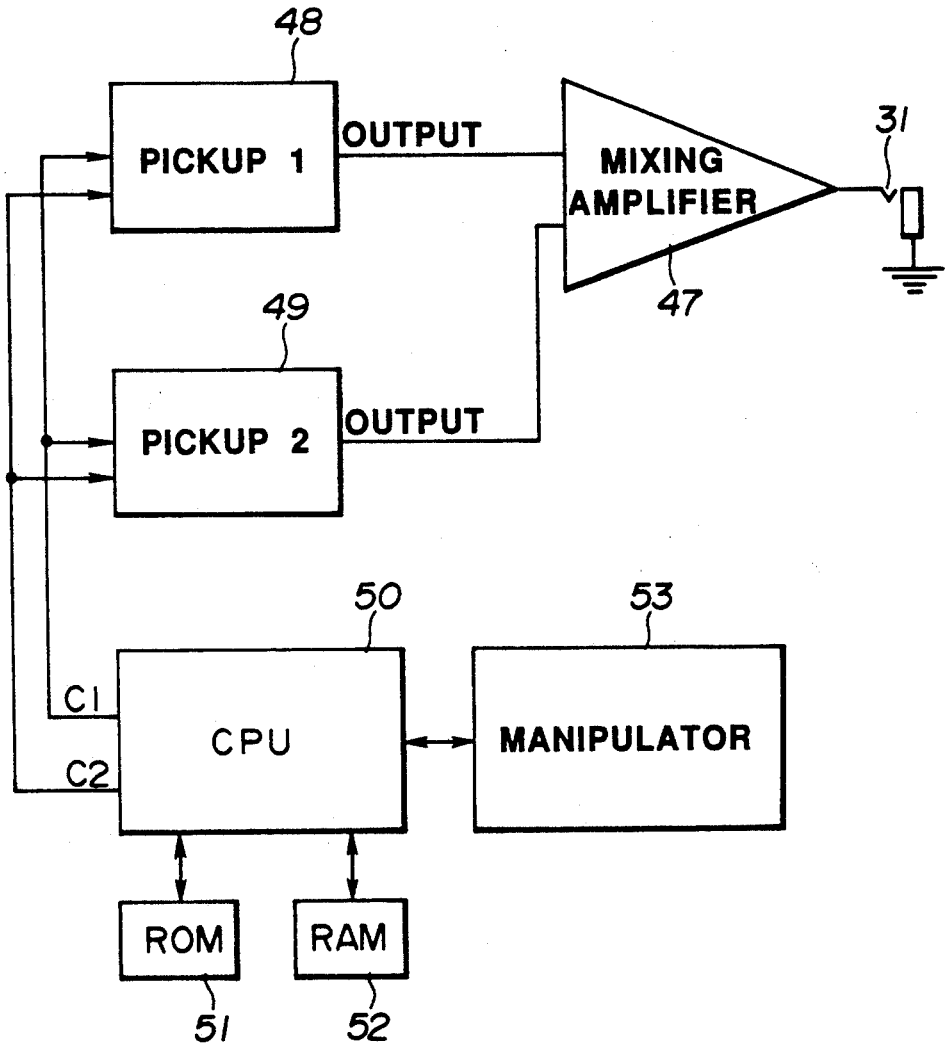
FIG. 15 is a circuit diagram illustrating the seventh embodiment of the present invention.

FIG. 15 shows the seventh embodiment of the present invention. Provided are a first pickup 48 and a second pickup 49 having a different characteristics. The outputs of the pickups 48 and 49 are combined by the mixing amplifier 47, whose output is sent to a jack 31. According to a program stored in a ROM 51, data temporarily stored in a RAM 52, and the operation of an manipulator 53, a CPU 50 outputs the control signals Cl and C2. The first and second pickups 48 and 49 function simultaneously or independently depending on the levels of the control signals Cl and C2.

Because of selecting the pickup 48 or 49 according to the levels of the control signals Cl and C2, there would be no noise generated unlike in the case where the selection is made by a switch. It is therefore possible to select the pickup 48 or 49 without generating noise. In the above-described embodiments, the upper end of the magnet 21 protrudes outside through the opening 14 formed in the casing 13. The casing 13 may, however, be structured to eliminate the need to form such an opening and to project the upper end of the magnet 21 outside the casing 13.

Figure 16:
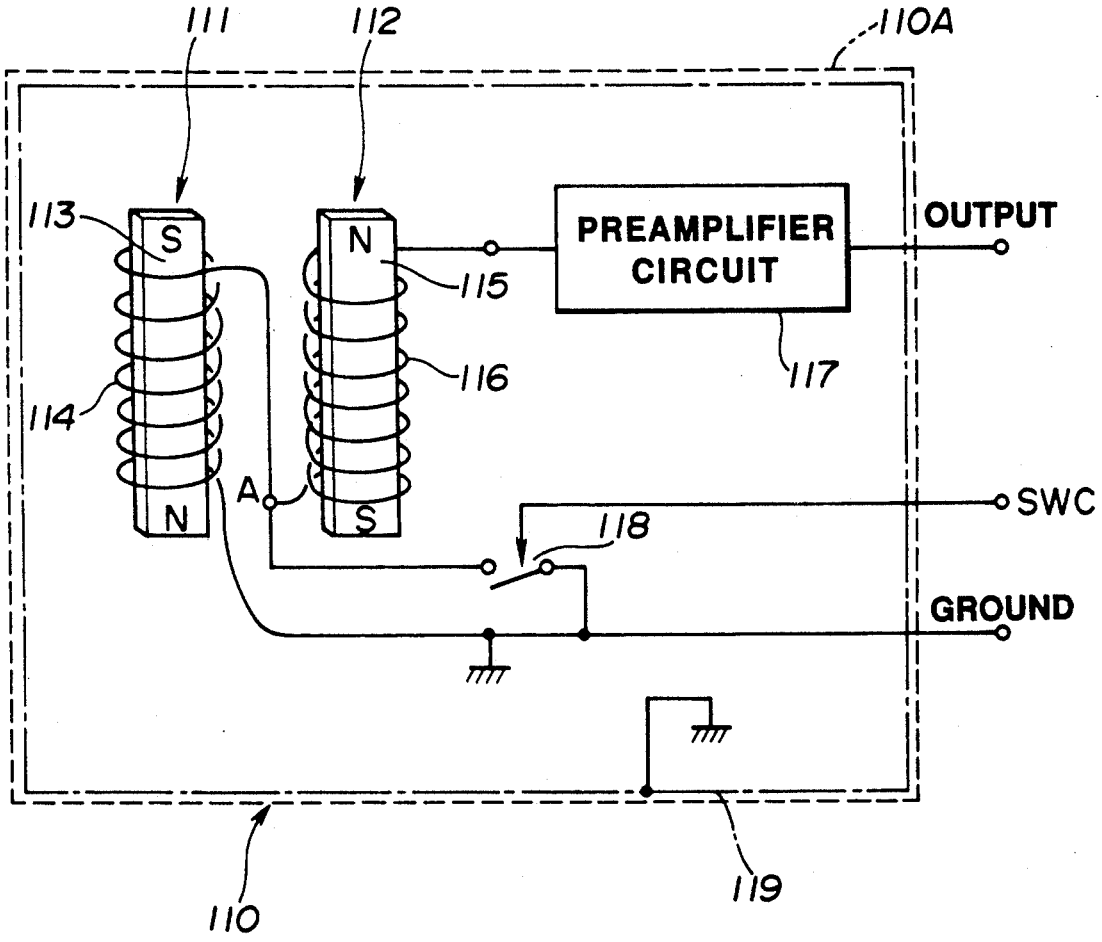
FIG. 16 is a circuit diagram illustrating the eighth embodiment of the present invention.

The FIG. 16 illustrates the eighth embodiment. A first pickup 111 and a second pickup 112 are placed in parallel inside a pickup device 110. The first pickup 111 includes a magnet, having an S pole at the upper end and an N pole at the lower end, and a coil 114 wound on the magnet 113. The second pickup 112 comprises a magnet 115, having an N pole at the upper end and an S pole at the lower end, and a coil 116 wound on the magnet 115. The coils 114 and 116 are connected in series; one end of the series circuit of the coils is connected to a preamplifier circuit 117, and the other end is grounded. A junction A between the coils 114 and 116 is connected to one end of an electronic switch 118 whose other end is grounded. The electronic switch 118 is open and closed based on the control signal SWC output from a CPU (not shown).

The preamplifier circuit 117 and the electronic switch 118 are incorporated in a casing 110A of the pickup device 110 as one unit, together with the pickups 111 and 112. The casing 110A constitutes a pickup support for supporting the pickups 111 and 112. Inside the casing 110A is a magnetic shield material 119 provided, which encloses the pickups 111 and 112, the preamplifier circuit 117, and the electronic switch 118. The upper ends of the respective magnets 113 and 115 project over the magnetic shield material 119 so as to face a string (not shown).

According to the thus structured embodiment, with the voltage of the control signal SWC having a predetermined low level, the electronic switch 118 is open, so that the pickup device 110 forms a hum-backing connection. When the string vibrates under such circumstances, and electromotive force is generated in the coils 114 and 116, a signal from the series circuit thereof is sent to the preamplifier 117. It is therefore possible to eliminate noise by the phase difference between the outputs of the coils 114 and 115, and to provide a characteristic, which makes it easy to catch a sound of a bass range and presents soft tone quality.

On the other hand, when the voltage of the control signal SWC has a predetermined high level, the electronic switch 118 is closed. The coil 114 on the first pickup 111 has a ground potential at both ends. Even if the string vibrates under this situation and the electromotive force is generated in the coils 114 and 116, the electromotive force of only the coil 116 of the second pickup 112 is applied to the preamplifier circuit 117. The pickup device 110 thus forms a single-coil-sound style connection, providing a characteristic which ensures extension of treble and a clear timbre.

The pickups 111 and 112, the preamplifier circuit 117, and the electronic switch 118 are incorporated as one unit in the casing 110A of the pickup device 110. The lead lines to connect them together do not run around inside the instrument body, preventing the tone quality from being deteriorated by external noise appearing on the lead lines. Moreover, since the magnetic shield material 119 encloses the pickups 111 and 112, the preamplifier circuit 117, and the electronic switch 118, external noise hardly appears on the connecting lines, thus providing a musical tone without deterioration of the tone quality.

If a plurality of the pickup devices 110 are installed on the body of a musical instrument, a guitar, for example, in association with individual strings, parallel connection of terminals for inputting the control signal SWC to the individual pickup devices 110 can permit the control signal SWC to be simultaneously supplied to all pickup devices 110 to control the simultaneous switching between a plurality of the pickup devices 110.

Figure 17:
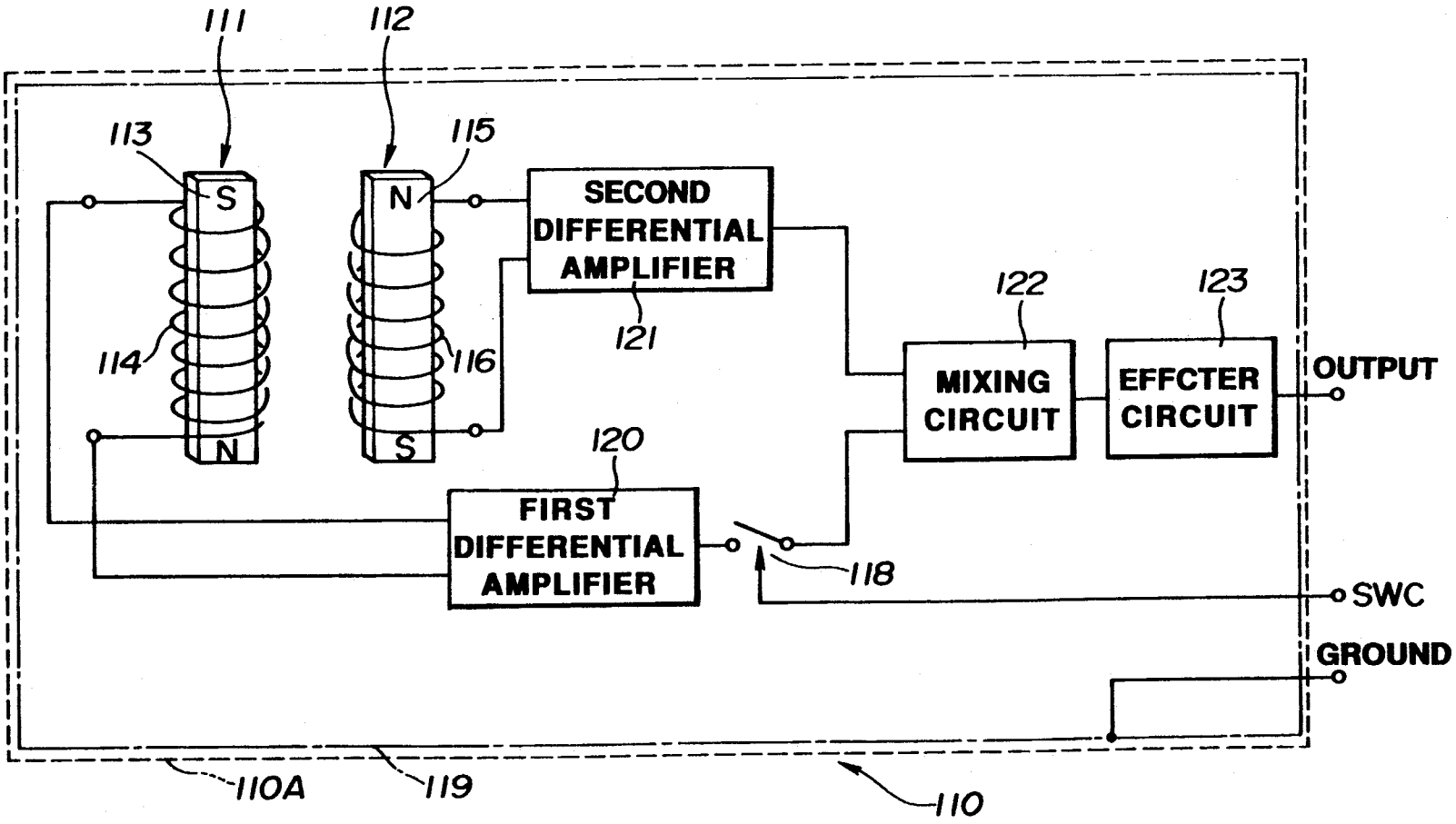
FIG. 17 is a circuit diagram illustrating the ninth embodiment of the present invention.

FIG. 17 illustrates the ninth embodiment of the present invention. The coil 114 of the first pickup 111 is connected to a first differential amplifier 120, while the coil 116 of the second pickup 11 is connected to a second differential amplifier 121. The outputs of the differential amplifiers 120 and 121 are sent to a mixing amplifier 122, which in turn supplies its output signal to an effecter circuit 123. The electronic switch 118 is provided between the output terminal of the second differential amplifier 121 and input terminal of the mixing amplifier 122. The first and second differential amplifiers 120 and 121, the mixing amplifier 122, and the effecter circuit 123 are incorporated together with the first and second pickups 111 and 112, and the electronic switch 118 as one unit in the casing 110A of the pickup device 110.

In the embodiment with such a structure, with the electronic switch 118 closed, the mixing amplifier 122 mixes the pickup signals from the respective pickups 111 and 112 which have been amplified by the first and second differential amplifiers 120 and 121; consequently, the pickup device 110 has a hum-backing connection. With the electronic switch 118 open, only the pickup signal of the first pickup 111, after amplified by the first differential amplifier 120, is output via the mixing amplifier 122 and the effecter circuit 123, setting the pickup device 110 to have a single-coil-sound connection.

As described above, the first and second differential amplifiers 120 and 121, the mixing amplifier 122, and the effecter circuit 23 are incorporated together with the first and second pickups 111 and 112, and the electronic switch 118 as one unit in the casing 110A of the pickup device 110. As a result, the lead lines would not be laid around inside the instrument, nor would noise on the lead lines be mixed and amplified by the mixing amplifier 122: No effect will be added to the noise by the effecter circuit 123.

While no external noise is carried on the pickup signal from the pickups 111 and 112 as described above, the mixing amplifier 122 can mix and amplify the pickup signals, or the effecter circuit 123 can add effects such as distortion and delay to a musical tone.

Moreover, according to this embodiment, the electronic switch 118 is provided on the output side of the differential amplifier 121. The noise at the ON/OFF time of the switch is not amplified by the differential amplifier 121, so that the mixing amplifier 122 can mix the amplified signal with less noise caused at the switching time. Also, located on the side of the output terminal of the mixing amplifier 122, the effecter circuit 123 may add effects to the pickup signals which are mixed under the condition of less noise as described above.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A pickup apparatus comprising:

electromagnetic pickup means including a magnet and a pickup coil wound about said magnet, said electromagnetic pickup means having first and second output ends for converting vibration of a string into an input electrical pickup signal and for providing said input electrical pickup signal across the first and second output ends thereof;

said input electrical pickup signal including an unwanted in-phase inductive noise signal that appears across the first and second output ends of said electromagnetic pickup means; and differential amplifier means having inverting and noninverting terminals for receiving said input electrical pickup signal from the first and second output ends of said electromagnetic pickup means across said inverting and noninverting terminals and for amplifying said input electrical pickup signal received at said inverting and non-inverting terminals, said differential amplifier providing an output pickup signal that is substantially free from said in-phase inductive noise.

2. A pickup apparatus according to claim 1, wherein the electromagnetic pickup means and said differential amplifier means are provided on a common pickup support member.

3. A pickup apparatus according to claim 1, further comprising added effect means for adding a predetermined effect to said output pickup signal from said differential amplifier means.

4. A pickup apparatus according to claim 3, wherein said electromagnetic pickup means, said differential amplifier means and said added-effect means are provided on a common pickup support member.

5. A pickup apparatus according to claim 1, further comprising:

added-effect means for adding a predetermined effect to said output pickup signal provided by said differential amplifier means and for providing an added-effect output signal; and externally manipulable characteristic control means for altering a tone characteristic of said added-effect output signal by an external manipulation of said added-effect means.

6. A pickup apparatus according to claim 5, wherein said electromagnetic pickup means, said added-effect means and said characteristic control means are provided on a common pickup support member.

7. A pickup apparatus according to claim 1, further comprising:

a plurality of added-effect means for respectively adding a plurality of different types of effects to said output pickup signal provided by said differential amplifier means; and select means for selecting at least an arbitrary one of said plurality of added-effect means and for providing a select output signal that corresponds to said output pickup signal from said differential amplifier means added to a specific selected effect of the selected added-effect means.

8. A pickup apparatus according to claim 7, wherein said plurality of pickup means, said plurality of added-effect means and said plurality of characteristic control means are provided on a control pickup support member.

9. A pickup apparatus according to claim 8, further comprising mixing means for mixing said added-effect output signals from said plurality of added-effect means and for outputting a resultant signal.

10. A pickup apparatus according to claim 9, wherein said plurality of pickup means, said plurality of added-effect means, said plurality of characteristic control means and said mixing means are provided on a common pickup support member.

11. A pickup apparatus according to claim 1, further comprising:

added-effect means for adding a predetermined effect to said output pickup signal provided for said differential amplifier means and for providing an added-effect output signal;

mixing means for mixing said added-effect output signal with said output pickup signal directly output from said differential amplifier means and for providing a resultant signal as a mixed pickup signal; and selecting means for selecting one of said mixed pickup signal from said mixing means and said pickup signal directly output from said differential amplifier means.

12. A pickup apparatus according to claim 11, wherein said pickup means, said differential amplifier means said added-effect means, said mixing means and said select means are provided on a common pickup support member.

13. A pickup apparatus according to claim 7, wherein said electromagnetic pickup means, said differential amplifier, said plurality of added-effect means, and said select means are provided on a common pickup support member.

14. A pickup apparatus according to claim 13, wherein said pickup support member is provided with a shield member for enclosing said electromagnetic pickup means.

15. A pickup apparatus according to claim 1, wherein said electromagnetic pickup means are surrounded by an electromagnetic shield member.

* * * * *